US011414632B2

(12) United States Patent
Agarkhed et al.

(10) Patent No.: US 11,414,632 B2
(45) Date of Patent: Aug. 16, 2022

(54) SOAP BAR WITH IMPROVED PERFUME IMPACT AND DEPOSITION OF ACTIVES

(71) Applicant: Conopco, Inc., Englewood Cliffs, NJ (US)

(72) Inventors: Ajit Manohar Agarkhed, Thane (IN); Prem Chandar, Closter, NJ (US); Connor Walsh, Seymour, CT (US); Nitish Kumar, Bihar (IN); Georgia L. Shafer, Southbury, CT (US); Guohui Wu, Woodbridge, CT (US)

(73) Assignee: CONOPCO, INC., Englewood Cliffs, NJ (US)

( * ) Notice: Subject to any disclaimer, the term of this patent is extended or adjusted under 35 U.S.C. 154(b) by 0 days.

(21) Appl. No.: 17/431,562

(22) PCT Filed: Feb. 24, 2020

(86) PCT No.: PCT/EP2020/054755

§ 371 (c)(1),
(2) Date: Aug. 17, 2021

(87) PCT Pub. No.: WO2020/178056

PCT Pub. Date: Sep. 10, 2020

(65) Prior Publication Data

US 2022/0098528 A1 Mar. 31, 2022

(30) Foreign Application Priority Data

Mar. 1, 2019 (EP) ..... 19160274

(51) Int. Cl.
*C11D 9/00* (2006.01)
*C11D 9/02* (2006.01)
*C11D 17/00* (2006.01)

(52) U.S. Cl.
CPC ..... *C11D 9/02* (2013.01); *C11D 17/0047* (2013.01)

(58) Field of Classification Search
None
See application file for complete search history.

(56) References Cited

U.S. PATENT DOCUMENTS

| | | | | |
|---|---|---|---|---|
| 2,820,768 | A | 1/1958 | Fromont | |
| 3,576,749 | A | 4/1971 | Megson et al. | |
| 4,468,338 | A | 8/1984 | Lindberg | |
| 4,874,538 | A | 10/1989 | Dawson et al. | |
| 5,540,852 | A * | 7/1996 | Kefauver | C11D 9/007 510/491 |
| 5,728,663 | A * | 3/1998 | Lambino | C11D 3/43 510/147 |
| 5,750,481 | A | 5/1998 | Del Vecchio et al. | |
| 6,852,681 | B1 | 2/2005 | Kerschner et al. | |
| 2002/0037818 | A1 * | 3/2002 | Schultz | C11D 17/006 510/141 |
| 2002/0039978 | A1 * | 4/2002 | Schultz | C11D 3/126 510/141 |
| 2011/0105612 | A1 | 5/2011 | Changaris | |
| 2014/0024573 | A1 * | 1/2014 | Agarkhed | C11D 9/26 510/394 |
| 2016/0376526 | A1 | 10/2016 | Smith | |
| 2016/0374973 | A1 | 12/2016 | Smith | |
| 2017/0121641 | A1 | 5/2017 | Smith | |

FOREIGN PATENT DOCUMENTS

| | | |
|---|---|---|
| CN | 103666884 | 3/2015 |
| EP | 0062352 | 7/1986 |
| EP | 0294010 | 12/1988 |
| GB | 2235930 | 3/1991 |
| WO | WO0022082 | 4/2000 |
| WO | WO0180821 | 11/2001 |
| WO | WO02053689 | 7/2002 |
| WO | W003002706 | 1/2003 |
| WO | WO03068901 | 8/2003 |
| WO | WO2004046294 | 6/2004 |
| WO | WO2004108877 | 12/2004 |
| WO | WO2005068601 | 7/2005 |
| WO | WO2005097964 | 10/2005 |
| WO | WO2006138738 | 12/2006 |
| WO | WO2011073139 | 6/2011 |
| WO | WO2012136502 | 10/2012 |
| WO | WO2013076047 | 5/2013 |
| WO | WO2015169678 | 11/2015 |
| WO | WO2015189566 | 12/2015 |
| WO | WO2016012163 | 1/2016 |
| WO | WO2017016802 | 2/2017 |
| WO | WO2017016803 | 2/2017 |
| WO | WO2017016807 | 2/2017 |

(Continued)

OTHER PUBLICATIONS

Search Report and Written Opinion in EP19160274; dated Jul. 23, 2019; European Patent Office (EPO).
Search Report and Written Opinion in EP19160273; dated Jul. 11, 2019; European Patent Office (EPO).
Search Report and Written Opinion in PCTEP2020054755; dated Apr. 24, 2020; World Intellectual Property Org. (WIPO).
Search Report and Written Opinion in PCTEP2020053435; dated Apr. 30, 2020; World Intellectual Property Org. (WIPO).
Written Opinion 2 in PCTEP2020054755; dated Feb. 22, 2021; World Intellectual Property Org. (WIPO).

(Continued)

*Primary Examiner* — Lorna M Douyon
(74) *Attorney, Agent, or Firm* — Krista A. Kostiew

(57) ABSTRACT

The present invention relates to an extruded bar soap composition. It more particularly relates to a soap bar composition which exhibits better bloom (perfume impact) and better deposition of actives as compared to conventional soap bars. This is obtained by ensuring that the amount of oleate soap is kept low while incorporating some amount of ricinoleate soap.

6 Claims, No Drawings

(56) References Cited

FOREIGN PATENT DOCUMENTS

| | | |
|---|---|---|
| WO | WO2017129472 | 8/2017 |
| WO | WO2020177988 | 9/2020 |

OTHER PUBLICATIONS

IPRP2 in PCTEP2020054755; dated Jun. 2, 2021; World Intellectual Property Org. (WIPO).
Written Opinion 2 in PCTEP2020053435; dated Feb. 19, 2021; World Intellectual Property Org. (WIPO).
IPRP2 in PCTEP2020053435; dated Jun. 1, 2021; World Intellectual Property Org. (WIPO).

* cited by examiner

SOAP BAR WITH IMPROVED PERFUME IMPACT AND DEPOSITION OF ACTIVES

CROSS REFERENCE TO RELATED APPLICATIONS

The present application is a U.S. National Phase Application under 35 U.S.C. § 371 of International Application No. PCT/EP2020/054755, filed on Feb. 24, 2020, which claims priority to European Patent Application No. 19160274.7, filed on Mar. 1, 2019, the contents of which are incorporated herein in their entireties.

FIELD OF THE INVENTION

The present invention relates to an extruded bar soap composition. It more particularly relates to a soap bar composition which exhibits better bloom (perfume impact) and better deposition of actives as compared to conventional soap bars.

BACKGROUND OF THE INVENTION

Surfactants have been used for personal wash applications for a long time. There are many categories of products in the personal wash market e.g. body wash, face wash, hand wash, soap bars, shampoos etc. Products which are marketed as body wash, face wash and shampoos are generally in liquid form and are made of synthetic anionic surfactants. They are sold in plastic bottles/containers. Soap bars and hand wash products generally contain soaps. Soap bars do not need to be sold in plastic containers and are able to retain their own shape by virtue of being structured in the form of a rigid solid. Soaps bars are usually sold in cartons made of cardboard.

Soap bars are generally prepared through one of two routes. One is called the cast bar route while the other is called the milled and plodded route. The cast bar route has inherently been very amenable in preparing low TFM (total fatty matter) bars. Total fatty matter is a common way of defining the quality of soap. It is defined as the total amount of fatty matter, mostly fatty acids, that can be separated from a sample of soap after splitting with a mineral acid, usually hydrochloric acid. In the cast bar soaps, the soap mixture is mixed with polyhydric alcohols and poured in casts and allowed to cool and then the soap bars are removed from the casts. The cast bar route enables production at relatively lower throughput rates.

In the milled and plodded route, the soap is prepared with high water content and then spray dried to reduce the moisture content and to cool the soap after which other ingredients are added and then the soap is extruded through a plodder and optionally cut and stamped to prepare the final soap bar. The milled and plodded soaps generally have a high TFM in the range of 60 to 80 weight percent.

Milled and plodded soap bars are also known as extruded soap bars. They are composed of very many different types of soaps. Most soaps comprise both water insoluble as well as water soluble soaps. Insoluble soaps usually consist of high amounts of higher chain C16 and C18 soap (stearate and palmitate soap). They are generally included in soap bars to provide structuring benefits i.e.; they provide shape to the bars. Soap bars also consist of water-soluble soaps which are generally unsaturated C18:1 and 18:2 sodium soap (oleate soap) in combination with short chain fatty acids (generally C8 to C12 or even up to C14 soap). Water soluble soaps generally aid in cleaning.

The present inventors found that when the amount of unsaturated higher chain fatty acid soaps e.g. oleate soaps are minimized or eliminated in the soap composition, it is possible to achieve higher perfume impact and better delivery of actives on to skin. However, when such oleate soaps are not included, it is very difficult to extrude such soap masses as there are processing difficulties in the manufacturing step of plodding (extrusion). The present inventors have been able to overcome this limitation by replacing the oleate fraction with some amount of sodium ricinoleate in combination with short chain fatty acid soap (C-8 to C12). Soap bars so made are found to have in use properties which are comparable to a conventional bar containing sodium oleates.

The newly formulated soap bar compositions are found to exhibit vastly improved perfume impact and enhanced deposition of actives as compared to conventional soap comprising oleates.

Soap bars containing ricinoleates and prepared using the extrusion route have been reported before. CN103666884 (Shanghai Bafang Fine Chemical, 2014) discloses a sanguisorba antibacterial compound soap, comprising the following raw materials in parts by weight: 0.05-0.15 part of sanguisorba extract, 15-25 parts of sodium cocoate, 50-70 parts of sodium ricinoleate, 3-5 parts of cocamidopropylamine oxide, 3-5 parts of cocoamidopropylamine oxide and 20 parts of water. Such soaps contain very high amount of ricinoleate soap and will have very high rate of wear.

It is thus an object of the present invention to provide a soap bar composition that comprises low or no amount of high molecular weight unsaturated soap e.g. oleates thus ensuring better perfume impact and enhanced delivery of actives.

It is another object of the present invention to provide for a soap bar composition that is low in oleates but can be processed easily in a conventional plodder to prepare soap bars of acceptable in use properties.

SUMMARY OF THE INVENTION

The present invention relates to a soap bar composition comprising 45 to 85 weight % total amount of soap wherein the composition comprises;

a) 1 to 40% of C8 to C12 fatty acid soap by weight of the composition;

b) 1 to 12% of ricinoleate soap by weight of the composition;

wherein the composition comprises less than 8% oleate soap by weight of the composition.

DETAILED DESCRIPTION OF THE INVENTION

These and other aspects, features and advantages will become apparent to those of ordinary skill in the art from a reading of the following detailed description and the appended claims. For the avoidance of doubt, any feature of one aspect of the present invention may be utilized in any other aspect of the invention. The word "comprising" is intended to mean "including" but not necessarily "consisting of" or "composed of." In other words, the listed steps or options need not be exhaustive. It is noted that the examples given in the description below are intended to clarify the invention and are not intended to limit the invention to those examples per se. Similarly, all percentages are weight/weight percentages unless otherwise indicated. Except in the operating and comparative examples, or where otherwise explicitly indicated, all numbers in this description and claims indicating amounts of material or conditions of reaction, physical properties of materials and/or use are to be understood as modified by the word "about". Numerical ranges expressed in the format "from x to y" are understood to include x and y. When for a specific feature multiple preferred ranges are described in the format "from x to y", it is understood that all ranges combining the different endpoints are also contemplated.

The present invention relates to a soap bar composition. By a soap bar composition is meant a cleansing composition comprising soap which is in the form of a shaped solid. The soap bar of the present invention comprises 45 to 85% total amount of soap. The term soap means salt of fatty acid. Preferably, the soap is soap of C8 to C24 fatty acids.

The cation may be an alkali metal, alkaline earth metal or ammonium ion, preferably alkali metals. Preferably, the cation is selected from sodium or potassium preferably sodium. The soap may be saturated or unsaturated. Saturated soaps are preferred over unsaturated soaps for stability. The oil or fatty acids may be of vegetable or animal origin.

The soap may be obtained by saponification of oils, fats or fatty acids. The fats or oils generally used to make soap bars may be selected from tallow, tallow stearins, palm oil, palm stearins, soya bean oil, fish oil, rice bran oil, sunflower oil, coconut oil, babassu oil, and palm kernel oil. The fatty acids may be from coconut, rice bran, groundnut, tallow, palm, palm kernel, cotton seed or soya bean.

The fatty acid soaps may also be synthetically prepared (e.g. by the oxidation of petroleum or by the hydrogenation of carbon monoxide by the Fischer-Tropsch process). Resin acids, such as those present in tall oil, may also be used. Naphthenic acids may also be used.

The soap bar may additionally comprise synthetic surfactants selected from one or more from the class of anionic, non-ionic, cationic or zwitterionic surfactants, preferably from anionic surfactants. These synthetic surfactants, as per the present invention, are included in less than 8%, preferably less than 4%, more preferably less than 1% and optimally absent from the composition.

The composition of the present invention is in the form of a shaped solid for example a bar. It is applied on the topical surface and left thereon only for a few seconds to minutes and washed off thereafter with copious amounts of water.

The soap bar of the present invention includes 45 to 85% total soap, preferably 50 to 80% more preferably 55 to 78% soap by weight of the composition. The soap bars of the present invention includes a substantial amount of low molecular weight soaps (C8 to C12 soaps) which are generally water soluble, which is in the range of 1 to 40%, preferably 2 to 35%, by weight of the composition. It is preferred that the soap bar includes 35 to 65 wt % of the soap of C16 to C22 fatty acid, which are generally water insoluble soaps. A further preferred aspect relates to the predominantly water insoluble soaps vis. stearate and palmitate soaps to be included in 40 to 72%, preferably 40 to 60% by weight of the composition.

The composition comprises 1 to 12%, preferably 4 to 10% ricinoleate soap by weight of the composition. By ricinoleate soap is meant a salt of ricinoleic acid/12-Hydroxy oleic acid.

Hydrolysis of castor oil yields about 85% ricinoleic acid. To ensure that the desired amount of ricinoleic acid soap is included, castor oil may be blended with other oils in calculated amounts for saponification.

It is important as per the invention that the composition comprises less than 8%, preferably 4%, more preferably less than 2%, furthermore preferably less than 1% of oleate soap by weight of the composition. Optimally, oleate soap is absent from the composition. All of the soap used in preparing the composition of the invention is preferably sodium soap.

The soap bar composition generally comprises electrolyte and water. Electrolytes as per this invention include compounds that substantially dissociate into ions in water.

Electrolytes as per this invention are not an ionic surfactant. Suitable electrolytes for inclusion in the soap making process are alkali metal salts. Preferred alkali metal salts include sodium sulfate, sodium chloride, sodium acetate, sodium citrate, potassium chloride, potassium sulfate, sodium carbonate and other mono or di or tri salts of alkaline earth metals, more preferred electrolytes are sodium chloride, sodium sulfate, sodium citrate, potassium chloride and especially preferred electrolyte is sodium chloride sodium sulphate, sodium citrate or a combination thereof. For the avoidance of doubt, it is clarified that the electrolyte is a non-soap material. Electrolyte is preferably included in 0.4 to 6%, preferably 1 to 3% by weight of the composition. Water is used as the slurrying medium for the soap and is preferably included in 15 to 21% by weight of composition.

The soap composition may be made into a bar by a process that including extruding the mixture in a conventional plodder. The plodded mass may then be optionally cut to a desired size and stamped with a desirable indicia.

The various ingredients that make up the final soap bar composition are as described below:

Organic and Inorganic Adjuvant Materials

The total level of the adjuvant materials used in the bar composition should be in an amount not higher than 50%, preferably 1 to 50%, more preferably 3 to 45% by weight of the soap bar composition.

Suitable starchy materials which may be used include natural starch (from corn, wheat, rice, potato, tapioca and the like), pre-gelatinized starch, various physically and chemically modified starch and mixtures thereof. By the term natural starch is meant starch which has not been subjected to chemical or physical modification—also known as raw or native starch.

A preferred starch is natural or native starch from maize (corn), cassava, wheat, potato, rice and other natural sources of it. Raw starch with different ratio of amylose and amylopectin: e.g. maize (25% amylose); waxy maize (0%); high amylose maize (70%); potato (23%); rice (16%); sago (27%); cassava (18%); wheat (30%) and others. The raw starch can be used directly or modified during the process of making the bar composition such that the starch becomes gelatinized, either partially or fully gelatinized.

Another suitable starch is pre-gelatinized which is starch that has been gelatinized before it is added as an ingredient in the present bar compositions. Various forms are available that will gel at different temperatures, e.g., cold water dispersible starch. One suitable commercial pre-gelatinized starch is supplied by National Starch Co. (Brazil) under the trade name FARMAL® CS 3400 but other commercially available materials having similar characteristics are suitable.

Polyol

Another organic adjuvant could be a polyol or mixture of polyols. Polyol is a term used herein to designate a compound having multiple hydroxyl groups (at least two, preferably at least three) which is highly water soluble, preferably freely soluble, in water.

Many types of polyols are available including: relatively low molecular weight short chain polyhydroxy compounds such as glycerol and propylene glycol; sugars such as sorbitol, manitol, sucrose and glucose; modified carbohydrates such as hydrolyzed starch, dextrin and maltodextrin, and polymeric synthetic polyols such as polyalkylene glycols, for example polyoxyethylene glycol (PEG) and polyoxypropylene glycol (PPG). Especially preferred polyol are glycerol, sorbitol and their mixtures.

The level of polyol can be important in forming a thermoplastic mass whose material properties are suitable for both high speed manufacture (300-400 bars per minute) and for use as a personal washing bar. For example, when the polyol level is too low, the mass may not be sufficiently plastic at the extrusion temperature (e.g., 40° C. to 45° C.) and the bars tend to exhibit higher mushing and rates of wear. Conversely, when the polyol level is too high, the mass may become too soft to be formed into bars by high speed at normal process temperature.

In a preferred embodiment, the bars of the invention comprise 0.1 to 20%, preferably 0.5 to 15% by weight polyol. Preferred polyols, as noted, include glycerol, sorbitol and mixtures thereof.

The adjuvant system may optionally include insoluble particles comprising one or a combination of materials. By insoluble particles is meant materials that are present in solid particulate form and suitable for personal washing. Preferably, there are mineral (e.g., inorganic) or organic particles.

The insoluble particles should not be perceived as scratchy or granular and thus should have a particle size less than 300 microns, more preferably less than 100 microns and most preferably less than 50 microns.

Preferred inorganic particulate material includes talc and calcium carbonate. Talc is a magnesium silicate mineral material, with a sheet silicate structure and a composition of Mg3Si4(OH)22 and may be available in the hydrated form. It has a plate-like morphology, and is essentially oleophilic/hydrophobic, i.e., it is wetted by oil rather than water.

Calcium carbonate or chalk exists in three crystal forms: calcite, aragonite and vaterite. The natural morphology of calcite is rhombohedral or cuboidal, acicular or dendritic for aragonite and spheroidal for vaterite.

Commercially, calcium carbonate or chalk known as precipitated calcium carbonate is produced by a carbonation method in which carbon dioxide gas is bubbled through an aqueous suspension of calcium hydroxide. In this process the crystal type of calcium carbonate is calcite or a mixture of calcite and aragonite.

Examples of other optional insoluble inorganic particulate materials include alumino silicates, aluminates, silicates, phosphates, insoluble sulfates, borates and clays (e.g., kaolin, china clay) and their combinations.

Organic particulate materials include insoluble polysaccharides such as highly crosslinked or insolubilized starch (e.g., by reaction with a hydrophobe such as octyl succinate) and cellulose; synthetic polymers such as various polymer lattices and suspension polymers; insoluble soaps and mixtures thereof.

Bar compositions preferably comprise 0.1 to 25% by weight of bar composition, preferably 5 to 15 by weight of these mineral or organic particles.

An opacifier may be optionally present in the personal care composition. When opacifiers are present, the cleansing bar is generally opaque. Examples of opacifiers include titanium dioxide, zinc oxide and the like. A particularly preferred opacifier that can be employed when an opaque soap composition is desired is ethylene glycol mono- or di-stearate, for example in the form of a 20% solution in sodium lauryl ether sulphate. An alternative opacifying agent is zinc stearate.

The product can take the form of a water-clear, i.e. transparent soap, in which case it will not contain an opacifier.

The pH of preferred soaps bars of the invention is from 8 to 11, more preferably 9 to 11.

A preferred bar may additionally include up to 30 wt % benefit agents. Preferred benefit agents include moisturizers, emollients, sunscreens and anti-ageing compounds. The agents may be added at an appropriate step during the process of making the bars. Some benefit agents may be introduced as macro domains.

Other optional ingredients like anti-oxidants, perfumes, polymers, chelating agents, colourants, deodorants, dyes, emollients, moisturizers, enzymes, foam boosters, germicides, additional anti-microbials, lathering agents, pearlescers, skin conditioners, stabilisers, superfatting agents, sunscreens may be added in suitable amounts in the process of the invention. Preferably, the ingredients are added after the saponification step. Sodium metabisulphite, ethylene diamine tetra acetic acid (EDTA), borax or ethylene hydroxy diphosphonic acid (EHDP) are preferably added to the formulation. According to another aspect of the present invention, there is provided use of a composition for providing enhanced perfume impact or enhanced deposition of actives. The invention will now be illustrated by means of the following non-limiting examples.

EXAMPLES

Example A, B and 1, 2: Perfume Impact of the Composition of the Invention as Compared to Control Sample The following two soap bar composition as shown in Table-1 were prepared:

| Ingredient (wt %) | Example A | Example B | Example 1 | Example 2 |
|---|---|---|---|---|
| Stearate + Palmitate | 31.5 | 31.5 | 45 | 45 |
| Oleate | 28 | 28 | 0 | 0 |
| C8 to C12 soap | 8.5 | 8.5 | 16 | 16 |
| Ricinoleate | 0 | 0 | 7.7 | 7.7 |
| Glycerine | 6 | 6 | 4 | 4 |
| Talc | 6 | 6 | 6 | 6 |
| Sodium chloride | 0.8 | 0.8 | 0.7 | 0.7 |
| Sodium Citrate | 0 | 0 | 2 | 2 |
| Perfume -1 | 1.185 | 0 | 1.185 | 0 |
| Perfume - 2 | 0 | 1.25 | 0 | 1.25 |
| Water | To 100 | To 100 | To 100 | To 100 |

The soap bars as prepared above were tested for perfume impact using the methodology below:

The fragrance availability of the cleansing compositions of the present invention were evaluated across the following three consumer relevant parameters:

Dry sniff—as the consumer perceives the smell of the bar.

During Use—Fragrance from 8% soap solution indicating the bloom of the fragrance during use.

Post Use—Fragrance intensity—measured post rinse-off

Sample Preparation:

Dry Sniff

The consumers smell the bar to assess the fragrance of the soap, to quantify the intensity of perfume given out by the composition. To evaluate and quantify the dry sniff the fragrance in the headspace of the soap bar was measured with headspace Gas chromatography and the components were identified by mass spectroscopy. For this, samples were made by grating the soap bar with cheese grater to obtain fine particulates. One gram of the composition was taken in 20 ml vial & sealed immediately with a rubber septum & equilibrated at 27° C. for 2.5 hours to create an equilibrium of the head space volatiles. Subsequently the vials were placed in an auto-sampler at 30° C.

During Use

Consumers evaluate the soap during use by the amount of perfume. To study the same 8% solution was made by solubilising 4 g of grated soap in 46 g of DM water at 50° C. in sealed vial. 3 ml of above soap solution was taken in 20 ml vial and sealed with rubber septum. Vials were equilibrated at 27° C. for 2.5 hours and sampled similar to dry sniff samples. Subsequently the vials were placed in an auto-sampler at 30° C.

Post Use

To quantify the deposition of the benefit agent on the skin surface. An 8% soap solution was made by procedure as described above. In vitro performance tests were performed on artificial skin samples (VITRO-SKIN™, IMS Corp., a synthetic substrate designed to mimic the surface chemistry of human skin). This 4 cm×4 cm VITRO-SKIN™ was dipped in soap solution for 15 seconds and then washed by shaking it for 30 seconds in 25 ml water. The procedure is repeated for a total of 3 times with 25 ml of fresh DM water each time. The VITRO-SKIN™ was then placed in the vial & sealed immediately with a rubber septum & equilibrated at 27° C. for 2.5 hours to create achieve an equilibrium of the head space volatiles. Subsequently the vials were placed in an auto-sampler at 30° C.

Headspace Analysis

Samples were analyzed by gas chromatography (GC) analysis of headspace gases. In this procedure, the equipment utilized was a solid phase microextraction (SPME) system employing an Hewlett packard G1530A (GC) flame ionization detector (FID). Mass spectrometer (MS) used was Hewlett Packard 5973 mass selective detector. This equipment measured relative perfume compound abundance in the headspace over the fragrance/boosting agent/water mixture, as well as over the fragrance/water mixture. One gram of fragrance/boosting agent/water mixture was prepared in 20 ml GC headspace sampling vials sealed with caps having septums (from Gerstel, Inc.) and held at 27° C. The GC column was a DB-1 column from Agilent J&W (inner diameter 0.25 mm, length 10 m, stationary phase thickness 0.25 μm). The GC conditions were as follows:

Injector in split-less mode with helium gas as carrier gas. Injection port was heated to 265° C., purge flow to split vent 100 ml/minute at zero minutes. Column was in constant flow mode with 0.7 ml/minute flow rate. Oven temperature ramp: hold at 500° C. for 2 minutes, then increase oven temperature at a rate of 35° C./minute to 100° C., 15° C./minute to 200° C., and then at 3° C./minute.

MS conditions were as follows:

solvent delay for 1 minute, scan starting from low mass 35 to high mass 300.

Autosampler's conditions were as follows:

Incubation for 30 minutes at 30° C. SPME fibre was inserted into the sample headspace for 10 minute extraction and then injected to the injector for a 1 minute desorption at 265° C.

The vials from the above three samples were analysed with capillary GC column. The PDMS (i.e. polydimethyl siloxane; apolar phase) and PEG (i.e. polyethylene glycol; polar phase) columns were used for this purpose.

The output from the GC was recorded as a series of peaks—each one representing a compound in the mixture passing through the detector. For data comparison, peak area for the peaks was obtained and added to show perfume levels. The area of a peak is proportional to amount of the compound that is present. The area can be approximated by treating the peak as a triangle. The area of a triangle is calculated by multiplying the height of the peak times its width at half height.

Table 2 shows the average sum area of peaks obtained by three different samples as described above.

Areas are then normalised with respect to the respective samples being compared against. The values for the samples as per the invention (Examples 1 and 2) are the ratio of the areas of the respective samples to the control samples (Examples A and B) respectively.

TABLE 2

| Study | Example A | Example -1 | Example - B | Example - 2 |
|---|---|---|---|---|
| Dry Sniff | 1.00 | 1.05 | 1.00 | 1.17 |
| During Use | 1.00 | 3.89 | 1.00 | 4.10 |
| Post Use (Deposition) | 1.00 | 2.76 | 1.00 | 1.95 |

The data in table-2 below indicates that the samples as per the invention (Examples-1 and 2) are more impactful in perfume perception as compared to respective control samples.

Examples C, D and 3: Effect of the Composition of the Invention (Example-3) on Bloom as Compared to Certain Marketed Soaps (Examples C and D)

Soap Compositions as shown in the table 3 below were prepared.

TABLE 3

| Ingredients (wr %) | C | D | 3 |
|---|---|---|---|
| C-8 to C14 soap | 9 | 16.4 | 16 |
| Sodium C16.18 (palmitate and stearate) | 32 | 36 | 44.5 |
| Sodium Oleates (18:1, 18:2, 18:3) | 27 | 29 | 0 |
| Sodium Ricinoleate | 0 | 0 | 7.7 |
| Glycerine | 6 | 0 | 4 |
| Talc | 6 | 0 | 6 |
| Sodium Choride | 0.7 | 0.7 | 0.7 |
| Sodium Citrate hydrate | 0 | 0 | 2 |
| Perfume | 1.2 | 1.2 | 1.2 |
| Water and minors | upto 100 | upto 100 | upto 100 |

The above samples were tested for dry sniff and in use sniff (bloom) and the results are summarized below in Table 4:

TABLE 4

| Study | Exp. C | Exp. D | Exp. 3 |
|---|---|---|---|
| Dry Sniff (Neat soap) | 1.00 | 1.42 | 1.42 |
| During Use (Soap solution - Bloom) | 1.00 | 1.28 | 4.7 |

The data in the table-4 above indicates that the composition of the invention (Example-3) gives better bloom (during use fragrance impact) as compared to composition outside the invention (Examples C and D).

The invention claimed is:

1. A soap bar composition comprising 45 to 85 weight % total amount of soap wherein the composition comprises;

a) 1 to 40% of C8 to C12 fatty acid soap by weight of the composition;

b) 1 to 12% of ricinoleate soap by weight of the composition;

wherein the composition comprises less than 8% oleate soap by weight of the composition, wherein total amount of stearate and palmitate soap is from 40 to 72% by weight of the composition.

2. The soap bar composition as claimed in claim 1, wherein the composition comprises less than 4% of oleate soap by weight of the composition.

3. The soap bar composition of claim 2, wherein the composition comprises less than 2% of oleate soap by weight of the composition.

4. The soap bar composition of claim 3, wherein the composition comprises less than 1% of oleate soap by weight of the composition.

5. The soap bar composition as claimed in claim 2, wherein oleate soap is absent from the composition.

6. The soap bar composition as claimed in claim 1, wherein all the soaps in the composition are sodium soaps.

* * * * *